US005109876A

United States Patent [19]

Hayden et al.

[11] Patent Number: 5,109,876

[45] Date of Patent: May 5, 1992

[54] CIGARETTE PAPER AND CIGARETTE INCORPORATING SAME

[75] Inventors: Rhonda F. Hayden, Winston-Salem; Elbert C. Jones, Jr., Sherrill's Ford, both of N.C.

[73] Assignee: R. J. Reynolds Tobacco Company, Winston-Salem, N.C.

[21] Appl. No.: 511,144

[22] Filed: Apr. 19, 1990

[51] Int. Cl.[5] ..... A24B 1/02

[52] U.S. Cl. ..... 131/365; 162/139

[58] Field of Search ..... 131/365; 162/139

[56] References Cited

U.S. PATENT DOCUMENTS

| | | |
|---|---|---|
| 2,181,614 | 11/1939 | Striefling . |
| 2,580,608 | 1/1952 | Schur et al. . |
| 2,738,791 | 3/1956 | Schur et al. . |
| 2,890,704 | 6/1959 | Lamm . |
| 2,998,012 | 8/1961 | Lamm . |
| 3,044,924 | 7/1962 | Schur . |
| 3,049,449 | 8/1962 | Allegrini . |
| 3,319,630 | 5/1967 | Orrmins . |
| 3,353,543 | 11/1967 | Sproull et al. . |
| 3,355,317 | 11/1967 | Keith et al. . |
| 3,615,811 | 10/1971 | Barrett . |
| 3,664,352 | 5/1972 | Norman et al. . |
| 3,744,496 | 7/1973 | McCarty et al. . |
| 4,231,377 | 11/1980 | Cline et al. . |
| 4,341,228 | 7/1982 | Keritsis et al. . |
| 4,420,002 | 12/1983 | Cline . |
| 4,433,697 | 2/1984 | Cline et al. . |
| 4,450,847 | 5/1984 | Owens . |
| 4,461,311 | 7/1984 | Mathews et al. . |
| 4,744,987 | 5/1988 | Mehra et al. . |
| 4,779,631 | 10/1988 | Durocher et al. . |
| 4,805,644 | 2/1989 | Hampl, Jr. et al. . |
| 4,892,590 | 1/1990 | Gill et al. . |
| 4,915,118 | 4/1990 | Kaufman et al. . |
| 5,074,321 | 12/1991 | Gentry et al. . |

FOREIGN PATENT DOCUMENTS

| | | |
|---|---|---|
| 0386868 | 9/1990 | European Pat. Off. . |

OTHER PUBLICATIONS

APV Anhydro Bulletin No. 165.
APV Anhydro Bulletin No. 701.

*Primary Examiner*—V. Millin
*Assistant Examiner*—J. Doyle

[57] ABSTRACT

Cigarettes have a tobacco rod including smokable material circumscribed by a paper wrapper. The paper wrapper includes a cellulosic base web (e.g., flax and/or wood pulp fibers) and particles of at least one inorganic filler material. The inorganic filler material includes particles of agglomerated calcium carbonate particles.

28 Claims, 1 Drawing Sheet

CIGARETTE PAPER AND CIGARETTE INCORPORATING SAME

BACKGROUND OF THE INVENTION

The present invention relates to paper, and in particular, to paper useful for the manufacture of cigarettes.

Popular smoking articles, such as cigarettes, have a substantially cylindrical rod shaped structure and include a charge of smokable material, such as shredded tobacco (e.g., cut filler), surrounded by a paper wrapper thereby forming a so-called "tobacco rod." It has become desirable to manufacture cigarettes having cylindrical filter elements aligned in an end-to-end relationship with the tobacco rod. Typically, a filter element is manufactured from cellulose acetate tow circumscribed by paper plug wrap, and is attached to the tobacco rod using a circumscribing tipping paper. It also has become desirable to perforate the tipping paper and plug wrap, in order to provide for dilution of drawn mainstream smoke with ambient air.

Papers useful for the manufacture of cigarettes normally include a cellulosic web (e.g., flax or wood pulp fibers), an inorganic filler material (e.g., particles of calcium carbonate), and burn additives (e.g., potassium citrate). Various papers useful for the manufacture of cigarettes are set forth in U.S. Pat. Nos. 2,580,608 to Schur et al; 2,181,614 to Striefling; 2,738,791 to Levy et al; 3,044,924 to Schur; 3,049,449 to Allegrini; 3,744,496 to McCarty et al; 4,433,697 to Cline et al; 4,420,002 to Cline; 4,231,377 to Cline et al; 4,461,311 to Mathews et al; 4,450,847 to Owens; 4,805,644 to Hampl, Jr. et al and 4,779,631 to Durocher et al.

It would be desirable to provide a paper, and particularly, a paper useful for the manufacture of cigarettes, which incorporates a unique inorganic filler material.

SUMMARY OF THE INVENTION

The present invention relates to paper, and in particular, to a paper having particles of an agglomerated matrix of particulate inorganic material incorporated therein as a filler material. A particularly preferred filler material is agglomerated particles of calcium carbonate, and most preferably, agglomerated precipitated particles of calcium carbonate. A typical paper of the present invention comprises (i) a cellulosic base web (e.g., flax and/or wood pulp fibers), and (ii) particles of inorganic filler material which includes an agglomerated matrix of particulate inorganic material.

Papers of the present invention are useful as wrappers in the manufacture of cigarettes and other smoking articles. In particular, papers of the present invention can circumscribe a charge of smokable material to form a tobacco rod.

Cigarettes of the present invention, when smoked, yield an ash which is cohesive, exhibits good integrity and is not flakey. In addition, such cigarettes tend to burn back in a uniform manner at a desirable rate, in order that such cigarettes provide a desirable number of puffs. Further, preferred cigarettes do not provide an undesirable off-taste and off-aroma to the mainstream and sidestream smoke generated thereby.

DETAILED DESCRIPTION OF THE PREFERRED EMBODIMENTS

Figure 1:
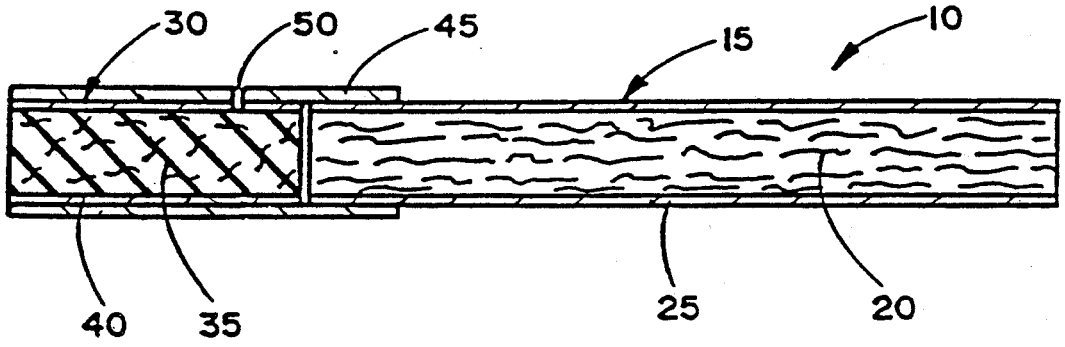
FIG. 1 is a longitudinal sectional view of a cigarette of the present invention.

One embodiment of a cigarette of the present invention is shown in FIG. 1. Cigarette 10 includes a generally cylindrical rod 15 of a charge or roll of smokable filler material 20 contained in circumscribing wrapping material 25. The rod 15 is conveniently referred to as a "smokable rod" or a "tobacco rod." The ends of the tobacco rod are open to expose the smokable filler material.

The cigarette 10 normally includes a filter element 30 or other suitable mouthpiece positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40. The filter element can have two or more filter segments, and/or flavor additives incorporated therein.

The filter element 30 is attached to the tobacco rod 15 by tipping material 45 which circumscribes both the entire length of the filter element and an adjacent region of the tobacco rod The inner surface of the tipping material 45 is fixedly secured to the outer surface of the plug wrap 40 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. Examples of suitable filter materials are cellulose acetate tow items having (i) about 3 denier per filament and about 35,000 total denier, and (ii) about 3.5 denier per filament and about 35,000 total denier. Such tow items conveniently provide filter elements exhibiting a removal efficiency of particulate matter from mainstream smoke of greater than about 40 weight percent. The plug wrap typically is a conventional paper plug wrap, and can be either air permeable or essentially air impermeable. However, if desired, a nonwrapped cellulose acetate filter element can be employed. Filter elements having two or more segments, and which are provided using known plug-tube-combining techniques, also can be employed. The various filter elements suitable for use in this invention can be manufactured using known cigarette filter making techniques and equipment.

The filler material employed in the manufacture of the smokable rod can vary. The preferred filler material is an "American blend" of tobacco materials. For example, the filler can include a blend of flue-cured, Burley, Maryland, Oriental, reconstituted and volume expanded tobaccos. Other suitable blends are described in European Patent Application No. 290,911 and U.S. patent application Ser. No. 416,332, filed Sep. 29, 1989, now U.S. Pat. No. 5,056,537 The filler material also can include those types of smokable materials described in U.S. patent application Ser. Nos. 276,161, filed Nov. 23, 1988, now U.S. Pat. No. 4,920,990. and 414,833, filed Sep. 29, 1989, now U.S. Pat. No. 5,074,321.

The smokable materials generally are employed in the form of cut filler as is common in conventional cigarette manufacture. For example, the smokable filler material can be employed in the form of shreds or strands cut into widths ranging from about 1/10 inch to about 1/60 inch, preferably from about 1/20 inch to about 1/40 inch. Generally, such pieces have lengths which range from about 0.25 inch to about 3 inches.

As used herein, "packing density" means the weight of the filler material which occupies a unit volume within the smokable rod. For articles of this invention, the packing density generally ranges from about 100 $mg/cm^3$ to about 300 $mg/cm^3$, more typically from about 150 $mg/cm^3$ to about 275 $mg/cm^3$.

Flavorants can be incorporated into the cigarettes. For example, the filler materials can be employed with casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives (e.g., organic acids) can be incorporated into the cigarette as additives to the cut filler. See, U.S. Pat. No. 4,830,028 to Lawson et al.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

The basis weights of the wrapping materials for the tobacco rod can vary. Typical basis weights for such wrapping materials range from about 10 $g/m^2$ to about 40 $g/m^2$, and often are about 20 $g/m^2$ to about 30 $g/m^2$. Typical basis weights do not exceed about 80 $g/m^2$.

Wrapping materials for the tobacco rod can have a wide range of permeabilities or porosities. Typical wrapping materials have inherent permeabilities which are below 400 CORESTA units, and frequently are below about 350 CORESTA units, about 100 CORESTA units, and sometimes are below about 50 CORESTA units. Wrapping materials can be electrostatically perforated to increase the net permeabilities thereof, particularly when the wrapping material has a low inherent porosity. Techniques for electrostatically perforating wrapping materials for cigarettes are apparent to the skilled artisan.

Typical wrapping materials are paper wrapping materials which contain about 60 to about 85, preferably about 65 to about 80 weight percent cellulosic material; and about 15 to about 40, preferably about 20 to about 35 weight percent filler material. The wrapping material can include at least one other inorganic filler material component in addition to the agglomerated filler material. Such other inorganic filler materials include particulate calcium carbonate (e.g., precipitated calcium carbonate), magnesium oxide, magnesium hydroxide, particulate calcium sulfate, fibrous calcium sulfate (e.g., Franklin Fiber available from US Gypsum Corp. in the form of A-30, A-45, H-30, H-45 and P-1), dolomite, or the like. Preferred paper wrapping materials contain about 1 weight percent agglomerated filler material, more preferably at least about 5 weight percent agglomerated filler material (i.e., all or a portion of the filler material of the wrapping material is agglomerated filler material). The preferred papers also contain flax fibers, wood pulp, esparto fiber, sisal fibers, or other cellulosic material to provide a cellulosic base web. Mixtures of 2 or more types of cellulosic materials can be employed.

At least a portion of the inorganic filler material has the form of particles of an agglomerated matrix of inorganic material. A particularly preferred inorganic filler material is agglomerated calcium carbonate, and most preferably, agglomerated precipitated calcium carbonate. Such materials are prepared by providing an aqueous slurry of calcium carbonate particles and a binding material, and drying the slurry to form an agglomerated matrix of calcium carbonate (i.e., a matrix of a plurality of calcium carbonate particles spaced within a continuous or semi-continuous phase of binding agent). Calcium carbonate particles which are employed to provide the agglomerated matrix typically exhibit a surface area of less than about 1 $m^2/g$, as determined using the BET method. The binding material employed to provide the agglomerated matrix of inorganic material can be an organic material or an inorganic material. Typical organic binding materials are cellulosic derivatives (e.g., sodium carboxymethylcellulose), and often are sugar containing materials, such as molasses, high fructose corn syrup, or Carob Powder Code 1739 from M. F. Neal, Inc. Typical inorganic binding materials include ortho phosphoric acid, potassium carbonate, sodium carbonate, and a glassy sodium polyphosphate available as Glass H from FMC Corp. Preferably, a high solids content aqueous slurry of calcium carbonate and binding material is spray dried to provide agglomerated particles (e.g., normally spherical particles) of calcium carbonate particles and binding material; and the resulting particles can be ground to a smaller size, if desired. Alternatively, the slurry can be dried by the application of heat to provide a solid mass of agglomerated calcium carbonate and binding material, and the solid mass can be ground to yield particles of the desired size.

The agglomerated matrix of inorganic filler material and binding material is subjected to heat treatment. Heat treatment causes inorganic binding agent to act to fuse the individual particles of the inorganic filler material together, and hence form the agglomerated structure or form. Heat treatment causes volatile components from organic binding material to be expelled, and calcine the organic binding material to form a water insoluble, carbonaceous material. A carbonaceous material consists primarily of carbon. Normally, the heat treatment of the agglomerated matrix is provided under controlled atmosphere, in order to minimize or prevent oxidation of organic binding material. When the binding agent is organic, the heat treatment provides a binding material which is carbonaceous, and in turn, provides a means for agglomerating the inorganic filler particles into a matrix form. The agglomerated calcium carbonate and binding agent particles can be heat-treated using an oven, a fluidized bed, rotary calciners, belt calciners, or the like. For example, spray dried calcium carbonate particles agglomerated using molasses can be heated in a fluidized bed having gaseous nitrogen heated at about 300° C. to about 425° C. flowing therethrough, and collected. After such a calcining process, the agglomerated calcium carbonate particles normally have a calcium carbonate content of greater than about 90 weight percent. Normally, the resulting agglomerated particles are screened to the desired size. Preferred agglomerated calcium carbonate and organic binding material particles which have been calcined are spherical in shape, are free flowing, and exhibit a bulk density of about 0.75 $g/cm^3$ to about 0.95 $g/cm^3$. As such, certain agglomerated calcium carbonate particles can provide an inorganic filler material having a bulk density less than about 2 $g/cm^3$, and preferably less than about 1 $g/cm^3$, which includes an inorganic component having a bulk density greater than about 2.5 $g/cm^3$. Normally, such agglomerated calcium carbonate particles exhibit a surface area or less than about 15 $m^2/g$, and often less than about 10 $m^2/g$, as determined using the Brunauer, Emmett and Teller (BET) method described in *J. Am. Chem. Soc.*, Vol. 60, p. 309 (1938).

Methods for providing agglomerated calcium carbonate particles are set forth in U.S. patent application Ser. No. 414,833, filed Sep. 29, 1989, now U.S. Pat. No. 5,074,321.

Agglomerated inorganic particles useful as inorganic filler materials for wrapping materials typically have diameters of less than about 100 microns, usually less than up to about 50 microns, and preferably less than about 25 microns. The particulate inorganic filler materials can have a fairly narrow distribution of particle sizes, or a fairly wide range of particle sizes can be employed. Typically, relatively high levels of inorganic filler materials of relatively large particle size provide wrapping materials having high porosities.

Agglomerated particles including calcined organic binding agent are very dark in color, and as such, wrapping materials incorporating such agglomerated particles can have a unique gray color or even be very dark in color. If desired, dark colored wrapping materials including agglomerated particles having calcined organic binding agent as a filler material component can be employed as inner wrappers of smokable rods. See, for example, U.S. Pat. Nos. 3,744,496 to McCarty et al and 4,561,454 to Guess.

The agglomerated inorganic particles are capable of acting as substrates for certain additives, and as such, certain additives can be incorporated into wrapping materials which incorporate such agglomerated particles as an inorganic filler component. For example, the agglomerated inorganic particles can have incorporated therein burn enhancers, ash conditioners, catalytic agents, oxidizing agents, pigments, flavoring agents (e.g., vanillin, cocoa, licorice, menthol, organic acids and tobacco extracts), flavor precursors (e.g., ethylvanillin glucoside and vanillin glucoside), and the like. The manner in which the additive is incorporated into the agglomerated particles can vary; and a particular additive can be incorporated in the agglomerated particles (i) by dissolving or dispersing the additive within a solvent, impregnating the agglomerated particles with the solvent and additive, and removing a significant amount of the solvent from the agglomerated particles; (ii) by incorporating the additive into the slurry of paper components during the paper manufacturing steps, such that the additive becomes impregnated within the agglomerated particles; or (iii) by applying the additive to the finished paper using gravure printing or size press techniques. Wrapping materials incorporating flavoring agents and/or flavor precursors in the agglomerated filler material thereof can be used as wrappers of the smokable rods of cigarettes so as to provide flavored and aromatic mainstream and sidestream smoke.

Wrapping materials of the present invention are manufactured using known papermaking techniques. In particular, a slurry of cellulosic material (e.g., flax and/or wood pulp) in water is formed; and inorganic filler material then is added to the slurry. If desired, papermaking additives, such as retention aids, can be incorporated into the slurry. A paper web then is formed on a screen or fabric; and the resulting web then is dried using known techniques. If desired, the paper can be manufactured so as to have verge lines. Methods for manufacturing paper materials are described in U.S. Pat. Nos. 4,450,847 to Owens as well as in *Handbook of Pulp and Paper Technology*, edit. by Britt (1970), and *Handbook for Pulp and Paper Technologists*, Smook (1982).

Wrapping materials for cigarettes often incorporate at least one burn enhancer or ash conditioner therein. Examples of burn enhancers include water soluble alkali metal salts such as sodium and potassium salts of citric acid, hydrochloric acid, carbonic acid, acetic acid, malic acid, succinic acid, tartaric acid, hydrochloric acid, nitric acid, propionic acid, carbonic acid, fumaric acid and glycolic acid. However, other burn enhancers can be employed. Typically, the burn enhancer or ash conditioner is incorporated into the wrapping material in an amount up to about 15 percent, generally up to about 12 percent, and frequently up to about 6 percent, based on the dry weight of the base wrapping material. In addition, the burn enhancer typically is incorporated into the wrapping material in an amount greater than about 0.25 percent, generally greater than about 1 percent, and frequently greater than about 3 percent, based on the dry weight of the base wrapping material. For many wrapping materials, the amount of burn enhancer incorporated therein ranges from about 0.3 to about 3 percent, based on the dry weight of the base wrapping material.

The manner in which burn enhancer or ash conditioner is incorporated into the paper wrap can vary. The burn enhancer can be incorporated into the paper during the manufacturing process. Alternatively, the burn enhancer can be incorporated into the paper using size press techniques, painting techniques, rotogravure techniques, or the like. Such techniques will be apparent to the skilled artisan. It is highly preferred that the burn enhancer be incorporated into the paper in an essentially uniform manner throughout the paper. Various burn enhancers can be incorporated into the paper simultaneously, or at different processing stages during or after paper manufacture.

The wrapping material of the smokable rod can be coated with a coating or film which includes a polymeric material. The preferred polymeric material has film-forming capabilities so as to form a coating or film over the surface of the wrapping material to which it is applied. Examples of polymeric materials include nitrocellulose, hydroxypropylcellulose, methylcellulose, carboxymethylcellulose and polyvinylacetate. If desired, specific polymeric materials can be employed in conjunction with suitable plasticizers (e.g., nitrocellulose can be employed in conjunction with dibutyl phthalate). The polymeric material can be soluble in an aqueous solvent or other solvents (e.g., ethylacetate, isopropylacetate or ethanol). Preferably, the polymeric material has a relatively low molecular weight in order to ensure easy application thereof to the wrapping material.

The coating optionally can include an inorganic filler material such as magnesium hydroxide, magnesium oxide, magnesium sulfate, magnesium carbonate, calcium sulfate and calcium carbonate. Combinations of two or more inorganic fillers can be employed. The inorganic filler is employed in the form of particles, normally in the range of about 0.3 micron to about 3 microns in diameter. Typically, the inorganic filler particles are fairly small, in order that an aesthetically pleasing (i.e., a non-grainy) surface is provided to the wrapping material. Preferred inorganic fillers provide an intumescent character to the wrapping material to which that filler is applied.

The following examples are provided in order to further illustrate the invention but should not be construed as limiting the scope thereof. Unless otherwise noted, all parts and percentages are by weight.

EXAMPLE 1

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g contained in a circumscribing cigarette paper wrapper. The cut filler employed in providing the tobacco rod is in the form of strands cut at about 32 cuts per inch. The filler material includes an "American blend" of tobacco materials.

The paper wrapper includes about 72 parts wood pulp (about 4 parts hardwood pulp and about 1 part softwood pulp) having a Canadian freeness of 80 to 120; about 23 parts precipitated calcium carbonate available as Albacar 5970 from Pfizer Inc.; and about 5 parts agglomerated calcium carbonate particles available as RX-3432 from Pfizer Inc. The precipitated calcium carbonate particles average about 2 microns in diameter and have a generally rosettic structure. The agglomerated calcium carbonate particles have a generally spherical shape, a surface area of about 8.4 $m^2/g$, an average particle size of about 10 to about 15 microns, and include a polyphosphate binding agent. The paper wrapper exhibits a basis weight of about 26.9 $g/m^2$; a porosity of about 329 CORESTA units; a thickness of about 0.088 mm; an opacity of about 76.3 percent as determined using a BNL-2 Opacimeter from Technidyne Corp.; a brightness of about 90.3 percent as determined by using a Brightmeter from Technidyne Corp.; and has a lineny appearance.

The paper is manufactured forming an aqueous slurry of wood pulp and inorganic filler at about 17° C. in a "Noble-Wood" sheet making mold having a 150 U.S. Mesh stainless steel wire screen. The slurry-containing mold is gravity drained, and the resulting sheet is transferred to a flat-bed dryer set at about 98° C. The sheet is dried to a moisture content of about 2 percent.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material. The tipping material is adhesively secured to the filter element and the adjacent portion of the tobacco rod. The tipping material circumscribes the length of the filter element and about 4 mm of the length of the tobacco rod The paper wrapper is positioned such that the "felt side" thereof faces the outside of the cigarette.

The cigarette is smoked and delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having a good integrity.

EXAMPLE 2

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g, contained in a circumscribing cigarette paper wrapper. The cut filler employed in providing the tobacco rod is in the form of strands cut at about 32 cuts per inch. The filler material includes an "American blend" of tobacco material.

The paper wrapper includes about 72 parts of the wood pulp described in Example 1; about 18 parts of the precipitated calcium carbonate described in Example 1; and about 10 parts of the agglomerated calcium carbonate described in Example 1. The paper is manufactured as described in Example 1.

The paper wrapper exhibits a basis weight of about 26.2 $g/m^2$; a porosity of about 305 CORESTA units; a thickness of about 0.087 mm; an opacity of about 72.4 percent; a brightness of about 88.5 percent; and has a lineny appearance.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material, as described in Example 1. The paper wrapper is positioned such that the "felt side" thereof faces the outside of the cigarette.

The cigarette is smoked and delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having good integrity.

EXAMPLE 3

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g, contained in a circumscribing cigarette paper wrapper. The cut filler employed in providing the tobacco rod is in the form of strands cut at about 32 cuts per inch. The filler material includes an "American blend" of tobacco material.

The paper wrapper includes about 72 parts of the wood pulp described in Example 1; about 13 parts of the precipitated calcium carbonate described in Example 1; and about 15 parts of the agglomerated calcium carbonate described in Example 1. The paper is manufactured as described in Example 1.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material, as described in Example 1. The paper wrapper is positioned such that the "felt side" thereof faces the inside of the cigarette.

The cigarette is smoked and delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having good integrity.

What is claimed is:

1. A cigarette including smokable filler material; contained in a circumscribing wrapping material; the wrapping material comprising (i) a cellulosic base web, and (ii) inorganic filler material including particles of an agglomerated matrix of particulate inorganic material.

2. The cigarette of claim 1 wherein the cellulosic base web of the wrapping material includes wood pulp and/or flax fibers.

3. The cigarette of claim 1 wherein the wrapping material includes at least one burn enhancer.

4. The cigarette of claim 1 wherein the wrapping material exhibits a basis weight of about 10 $g/m^2$ to about 40 $g/m^2$.

5. The cigarette of claim 1 wherein the wrapping material exhibits a basis weight of about 20 $g/m^2$ to about 30 $g/m^2$.

6. The cigarette of claim 1 or 4 wherein the wrapping material exhibits an inherent permeability of less than about 350 CORESTA units.

7. The cigarette of claim 1 wherein the wrapping material includes electrostatic perforations.

8. The cigarette of claim 1 wherein the wrapping material contains about 65 to about 85 weight percent cellulosic base web, and about 15 to about 35 weight percent inorganic filler material.

9. The cigarette of claim 1 or 8 wherein essentially all of the inorganic filler material of the wrapping material is particles of an agglomerated matrix of particulate inorganic material.

10. The cigarette of claim 1 or 8 wherein the wrapping material includes at least one other inorganic filler material.

11. The cigarette of claim 10 wherein the other inorganic filler material of the wrapping material includes particulates of precipitated calcium carbonate.

12. The cigarette of claim 1, 2, 3, 4, 5 or 8 wherein the wrapping material comprises inorganic filler material including particles of an agglomerated matrix of particulate calcium carbonate.

13. The cigarette of claim 12 wherein the wrapping material exhibits an inherent permeability of less than about 350 CORESTA units.

14. The cigarette of claim 12 wherein the wrapping material includes at least one other inorganic filler material.

15. The cigarette of claim 12 wherein the agglomerated matrix of particulate calcium carbonate has a particulate form of up to about 50 microns in diameter.

16. The cigarette of claim 1 wherein the binding material of the agglomerated matrix is an inorganic binding material.

17. The cigarette of claim 1 wherein the binding material of the agglomerated matrix is a carbonaceous material.

18. The cigarette of claim 16 wherein the inorganic binding material is a polyphosphate binding agent.

19. A wrapping material for smoking articles having:

(i) a basis weight of about 10 $g/m^2$ to about 40 $g/m^2$;

(ii) an inherent permeability of less than 400 CORESTA units;

(iii) a cellulosic base web; and (iv) inorganic filler material including particles of an agglomerated matrix of particulate inorganic material spaced within a binding material.

20. The wrapping material of claim 19 wherein the particles of agglomerated matrix of particulate inorganic material are particles of an agglomerated matrix of particulate calcium carbonate.

21. The wrapping material of claim 20 wherein the cellulosic base web includes wood pulp and/or flax fibers.

22. The wrapping material of claim 19 including about 65 to about 85 weight percent cellulosic base web filler material.

23. The wrapping material of claim 19 or 20 including at least one other inorganic filler material.

24. The wrapping material of claim 20 wherein essentially all of the inorganic filler material is particles of an agglomerated matrix of particulate calcium carbonate.

25. The wrapping material of claim 19 or 20 wherein the agglomerated matrix of particulate inorganic material has a particulate form of up to about 50 microns in diameter.

26. The wrapping material of claim 19 wherein the binding material for the agglomerated matrix is a carbonaceous material.

27. The wrapping material of claim 19 wherein the binding material for the agglomerated matrix is an inorganic binding material.

28. The wrapping material of claim 27 wherein the inorganic binding material is a polyphosphate binding agent.

* * * * *